US008353587B2

(12) United States Patent
Münch et al.

(10) Patent No.: US 8,353,587 B2
(45) Date of Patent: Jan. 15, 2013

(54) METHOD AND DEVICE FOR DISPENSING DATA FROM A TACHOGRAPH

(75) Inventors: Ulrich Münch, Dauchingen (DE); Jan Schlüter, Villingen-Schwenningen (DE); Denis Smolin, Villingen-Schwenningen (DE)

(73) Assignee: Continental Automotive GmbH, Hannover (DE)

( * ) Notice: Subject to any disclaimer, the term of this patent is extended or adjusted under 35 U.S.C. 154(b) by 304 days.

(21) Appl. No.: 12/679,847

(22) PCT Filed: Sep. 24, 2008

(86) PCT No.: PCT/EP2008/062714

§ 371 (c)(1), (2), (4) Date: Mar. 24, 2010

(87) PCT Pub. No.: WO2009/040357

PCT Pub. Date: Apr. 2, 2009

(65) Prior Publication Data

US 2010/0194817 A1 Aug. 5, 2010

(30) Foreign Application Priority Data

Sep. 25, 2007 (DE) ..... 10 2007 045 966

(51) Int. Cl.

| | |
|---|---|
| ***B41J 2/005*** | (2006.01) |
| ***G01P 15/00*** | (2006.01) |
| ***G01P 1/14*** | (2006.01) |
| ***G01D 9/28*** | (2006.01) |

(52) U.S. Cl. ..... 347/101; 73/489; 346/50; 346/33 D

(58) Field of Classification Search ..... 73/489; 346/33 D, 50

See application file for complete search history.

(56) References Cited

U.S. PATENT DOCUMENTS

| | | | | |
|---|---|---|---|---|
| 3,634,866 | A * | 1/1972 | Meyer | 346/33 D |
| 4,835,546 | A | 5/1989 | Keller | |
| 5,305,219 | A | 4/1994 | Ishibashi et al. | |
| 5,639,967 | A | 6/1997 | Alexis | |
| 2002/0062191 | A1 | 5/2002 | Yanagisawa | |
| 2005/0134673 | A1 | 6/2005 | Bendek | |

FOREIGN PATENT DOCUMENTS

| | | |
|---|---|---|
| DE | 10343689 | 9/2005 |
| EP | 1193134 | 4/2002 |
| JP | 3052093 | 3/1991 |
| WO | WO 9308543 | 4/1993 |
| WO | WO 2004/017264 | 2/2004 |

OTHER PUBLICATIONS

Council Regulation (EEC) No. 3821/85 of Dec. 20, 1985 on recording equipment in road transport.

Bosch GmbH; Kraftfahrtechnisches Taschenbuch; 25th revised and enlarged edition; published by Vieweg Verlag; ISBN 3-528-23876-3; Oct. 2003; two cover sheets, pp. 1083-1085; Plochingen; Germany.

* cited by examiner

*Primary Examiner* — Jerry Rahll
(74) *Attorney, Agent, or Firm* — Cozen O'Connor

(57) ABSTRACT

A method and to a device for dispensing data from a tachograph to an endless printing medium. A first division is plotted in the longitudinal direction of the printing medium, and a second division is plotted transversely with respect to the longitudinal direction of the printing medium. The first division represents a predetermined unit of time, in particular a day in generalized time coordinates, and the second division represents at least one variable recorded by the tachograph during the unit of time, the at least one variable is depicted by at least one graph.

16 Claims, 7 Drawing Sheets

METHOD AND DEVICE FOR DISPENSING DATA FROM A TACHOGRAPH

PRIORITY CLAIM

This is a U.S. national stage of application No. PCT/EP2008/062714, filed on 24 Sep. 2008, which claims priority to the German Application No. 10 2007 045 966.3, filed: 25 Sep. 2007; the content of both incorporated herein by reference.

BACKGROUND OF THE INVENTION

1. Field of the Invention

The present invention relates to a method and to a device for dispensing data from a tachograph to an endless printing medium.

2. Prior Art

Tachographs are used in motor vehicles for recording data with regard to the vehicle activities and the driver activities. In addition, states of digital inputs of the tachograph can be recorded. The recorded data is stored in the tachograph over a certain period of time and can be dispensed to a printing medium, e.g. for control purposes.

It is legally specified what data is to be recorded. The tachograph usually keeps the recorded data stored for one year. Via a printer provided in the tachograph, control printouts of periods to be selected can be output on a printing medium. The printing medium is paper that comes from an endless roll. Anticipating the description of the figures, FIG. 2 is a typical printout as known in the prior art. Such a printout consists of a sequence of various data blocks which in each case have a predetermined significance. At the beginning of a printout, date and clock time of the printout are specified, followed by any information relating to the type of the printout, information relating to the authorization of the person who initiated the printout and information relating to the vehicle, to the tachograph manufacturer, to the calibration of the tachograph, to the last check and to the relevant driver. This is followed by lines of information relating to the actual vehicle and driver activities together with respective clock times of a day. The data output are essentially in text form. EEC regulation No. 3821/85 of Dec. 20, 1985 specifies contents and symbols for this.

It is especially during vehicle checks in road traffic that a problem occurs that very many printouts must be checked within a short time, probably even in darkness, and other peripheral devices that could provide for a comfortable transfer of data from the tachograph are not available.

SUMMARY OF THE INVENTION

It is an object of the present invention, to provide a method and a device for printing out data from a tachograph that meets these requirements.

According to one embodiment of the invention, a method for dispensing data from a tachograph to an endless printing medium is provided, wherein a first division is plotted in the longitudinal direction of the printing medium and wherein a second division is plotted transversely with respect to the longitudinal direction of the printing medium, wherein the first division represents a predetermined unit of time, in particular a day in generalized time coordinates, and the second division represents at least one variable recorded by the tachograph during the unit of time, and the at least one variable is depicted by at least one graph.

The invention is associated with numerous advantages. Thus, the method according to one embodiment of the invention, utilizes the limited possibilities of the output medium of the tachograph with regard to the resolution and the space for the printout.

Advantageous embodiments of the invention include one or more of the following features:

A variable to be recorded can be one of speed, driving activity, digital states.

Desired data (driver activities, vehicle speed and the states of the digital inputs) can then be processed visually easily detectably for the user in a narrow space, in a space-saving and particularly reliable manner.

A graph can comprise at least one bar, the height of which has discrete steps, wherein the steps characterize the recorded variables.

In particular, the depiction of the driver's activities and of the states by means of bars, the height of which codes the respective driver's activities and states, is reliably detectable for monitoring persons.

The second division can be subdivided into days and the variable to be monitored can be the driver's activity or a digital state.

The user obtains the possibility of outputting and viewing the data recorded by the tachograph alone by means of the graphic printout without the assistance of additional devices or applications.

In the event of a failure of the variable to be monitored, auxiliary lines which facilitate a manual entry on the printing medium can be inserted into the graph instead of the variable to be monitored.

This facilitates the gapless coverage of the data for the driver and thus ensures that the recordings can be monitored even in the event of a temporary failure or incorrect operation of the tachograph.

The variable can be averaged in a sliding manner over a predetermined number of values and the average value can be plotted.

This further increases the clarity of the output.

In the at least one graph, two states which are variable over the plotted time can be represented. In the case of at least one change of the state in one interval compared with the state of the preceding interval, the respective other state is output as state for one interval and wherein, in the case of no change of the state in one interval, the state is output for the entire interval.

This emphasizes state changes more strongly.

The output comprises a head section, a trunk section, and a foot section. The head section comprises identification data for at least one driver. The trunk section comprises the divisions and the at least one graph. The foot section comprises a signature field.

An output arranged in this manner provides a particularly neat division of the printout which, in turn, improves the checkability.

On one side of the trunk section, a legend for the at least one graph can be specified.

This measure facilitates understanding of the significance of the graph and thus accelerates the check.

The first division can be the same for a predetermined quantity of outputs.

This measure facilitates the checking of different printouts for identical periods.

Auxiliary lines can be plotted for delimiting the at least one graph. This measure, too, facilitates understanding of the significance of the graph and thus accelerates the check.

The printing medium can be paper from a roll and the longitudinal direction is preferably a direction of unrolling.

This represents the compatibility with the existing tachograph hardware.

The invention also comprises a printing device for a tachograph which is adapted for carrying out the method according to the invention.

BRIEF DESCRIPTION OF DRAWINGS

The invention will be described in greater detail with reference to the drawing, in which.

DETAILED DESCRIPTION OF THE DRAWINGS

Figure 1:
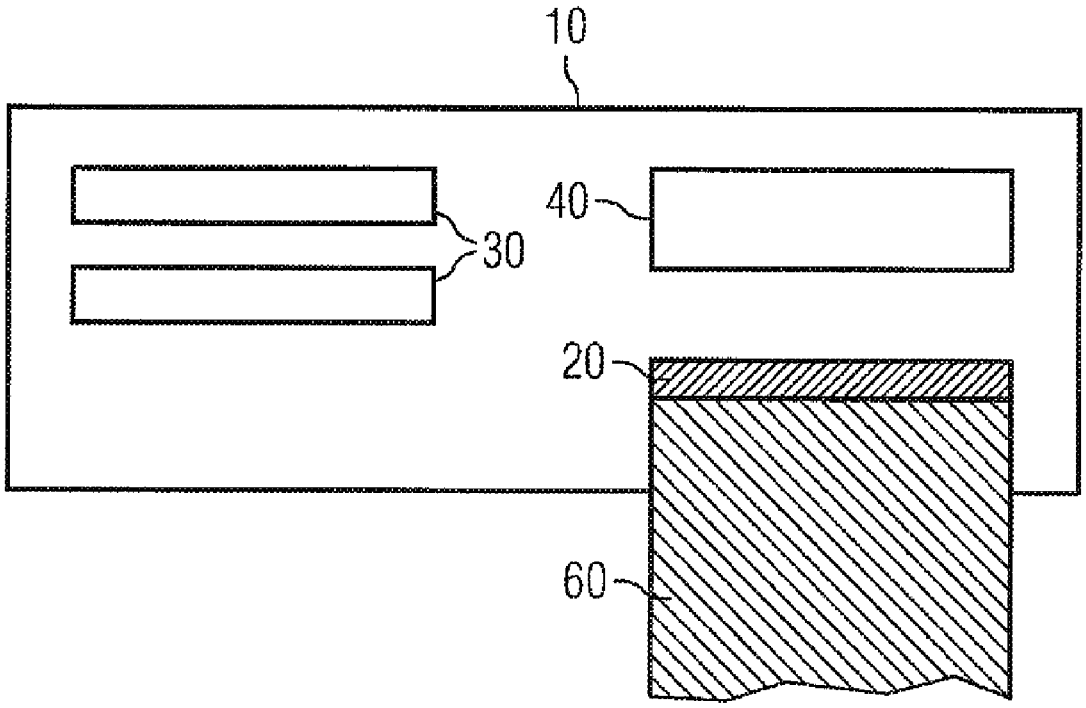
FIG. 1 is a tachograph in which the method according to the invention can be applied.

FIG. 1 is a digital tachograph as is used in the present day. Apart from at least one chip card slot 30 which is used for accepting chip cards which store driver-related data, and a display 40, the tachograph 10 comprises a printer 20 as output device which generates a printout of the recorded data on endless paper 60.

Figure 2:
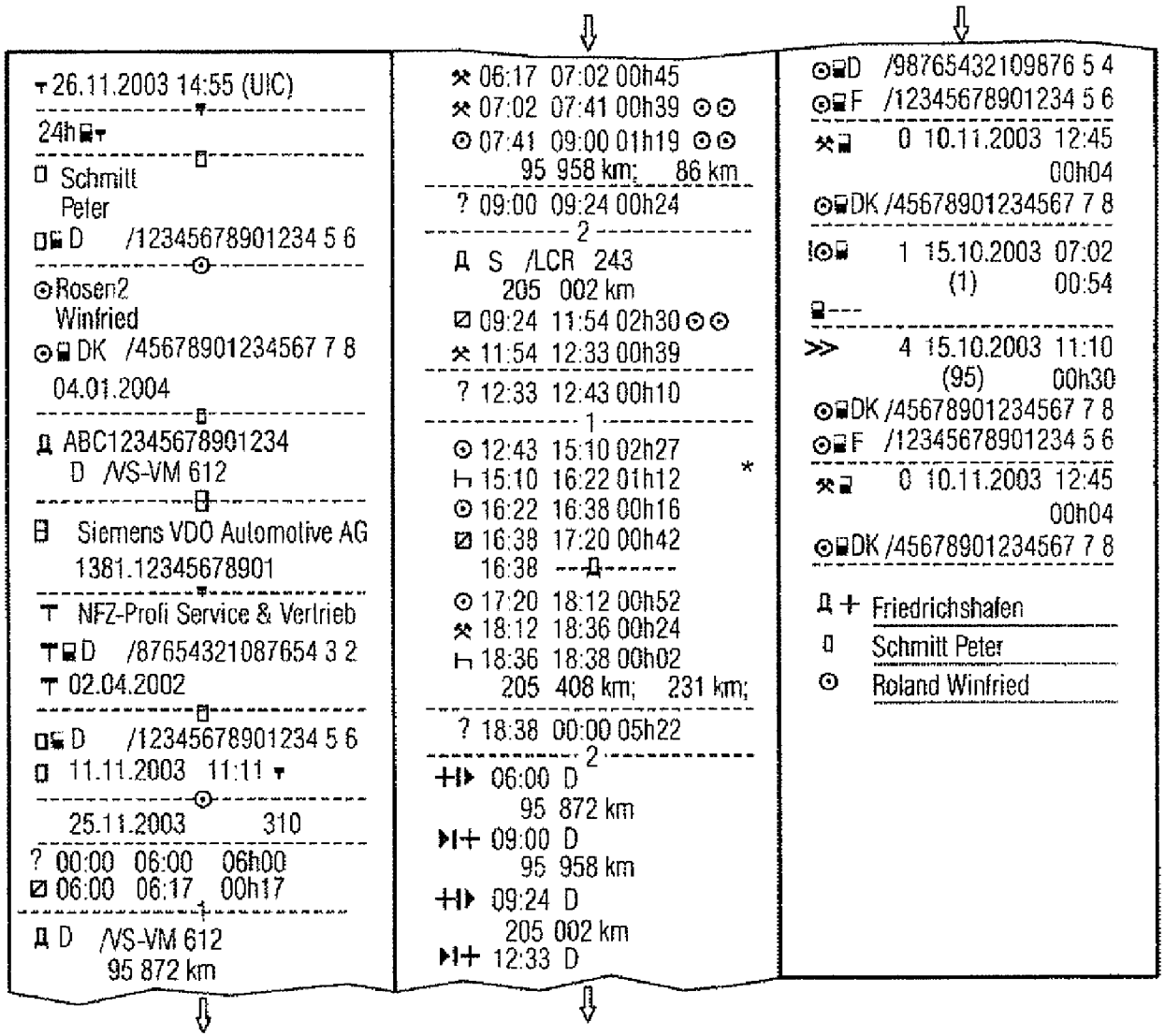
FIG 2 Prior art
FIG. 2 is a printout according to the prior art.
Figure 3:
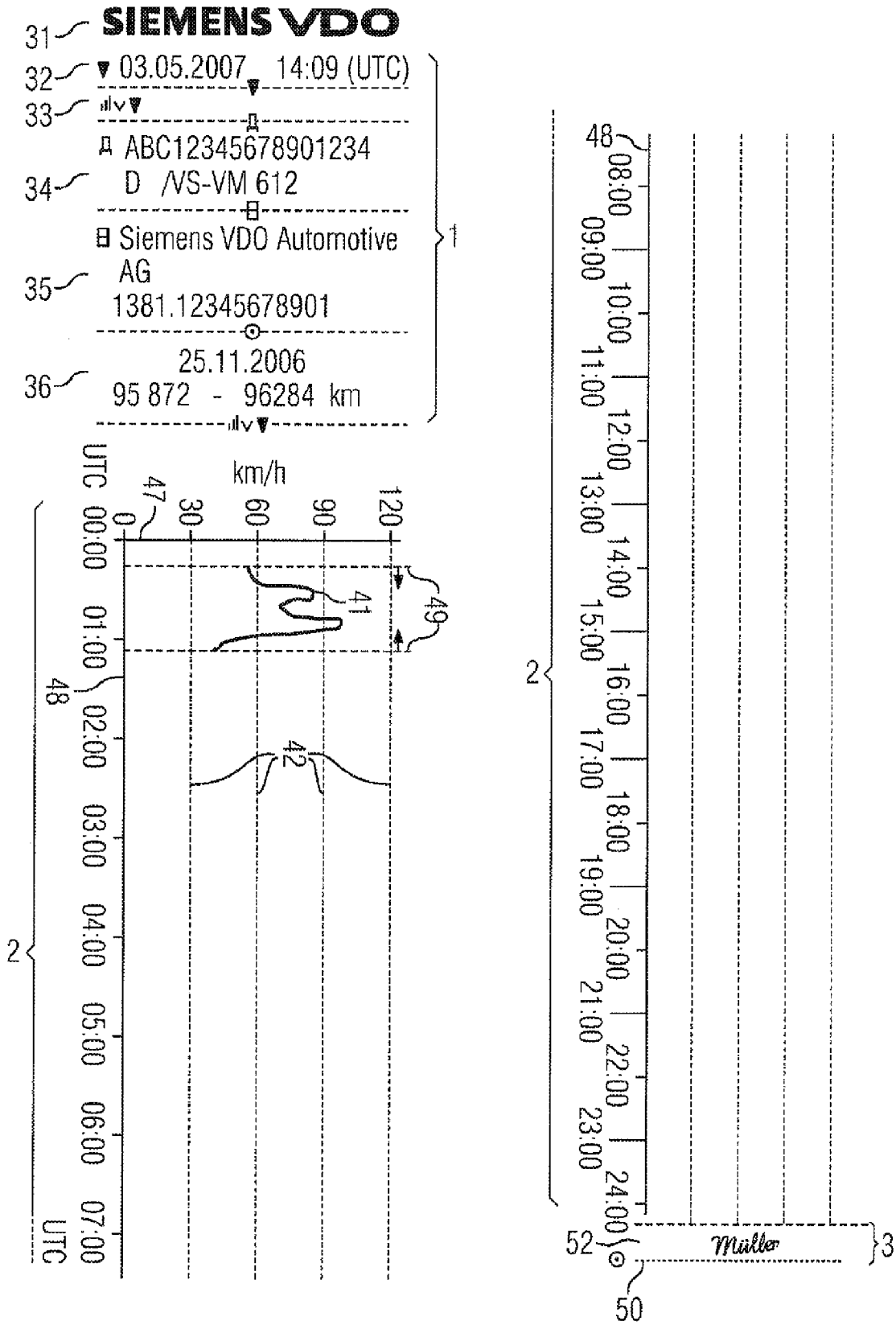
FIG. 3 is a printout of the vehicle speed, generated in accordance with the invention.
Figure 4:
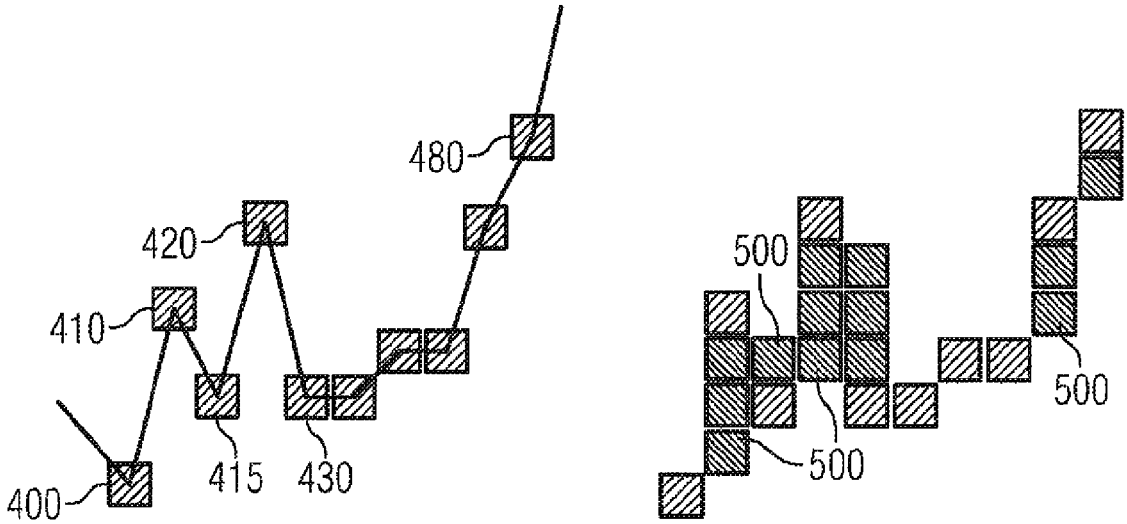
FIG. 4 is a detail of the graphical output of the vehicle speed.

As already explained initially, FIG. 2 shows a printout as is generated by a method according to the prior art.

The printout generated by means of the method according to the invention is described in conjunction with FIGS. 3 to 7. A printout according to an exemplary embodiment of the invention is subdivided into three sections, namely head section 1, trunk section 2 and foot area 3.

The head section 1 of each printout comprises a number of blocks, namely the manufacturer's logo 31, data and clock time of the printout in coordinated universal time (UTC) 32, a pictogram for the printout type 33, a vehicle identification 34, a manufacturer's information for the tachograph plus device number 35 and specification of the date of the day to which the printout relates, and the kilometer reading at the beginning and at the end of the day (00:00 hours and 24:00 hours) 36.

In the trunk section 2, the acquired data is output over the predetermined recording period, in this case 24 hours, in the form of a graph in a system of coordinates. In the longitudinal direction of the printing medium, that is to say on the abscissa 48, the hours are plotted in coordinated universal time, beginning with 00:00 hours to 24:00 hours. In the transverse direction, that is to say on an ordinate 47, the speed is plotted, between 0 and 120 km/h in the present example. If the speed is once over 120 km/h within the recording period, the division is set from 0 to 240 km/h. A dotted auxiliary line 42 is generated in each case through the entire trunk area in the 30 km/h grid. These auxiliary lines facilitate reading of the speed.

The abscissa is subdivided into hours, quarter hours and 5-minute grids. The graph 41 of the speed is shown in those areas in which the speed differs from 0. These areas are delimited by lines 49.

Due to the limited resolution in the output, the depiction is accurate only to 20 seconds even though the data is preferably recorded with accuracy of seconds in the tachograph. For this reason, the speed in the graph 41 within the 20 seconds is depicted as average value over this period of time. Even if the vehicle has moved only for a very short time (the average value would be almost 0 km/h), this is represented by a peak 410, 420 of at least 2 pixels, height in the graph. For better legibility in the printout, points 400, 410, 415, 420, 430, . . . , 480 of the graph are joined by vertical pixel lines 500 above and below the speed point to be depicted, compare FIG. 4.

In the foot section 3, 50 of the printout, a signature field 50 is generated which provides the possibility for a signature 52.

Figure 5:
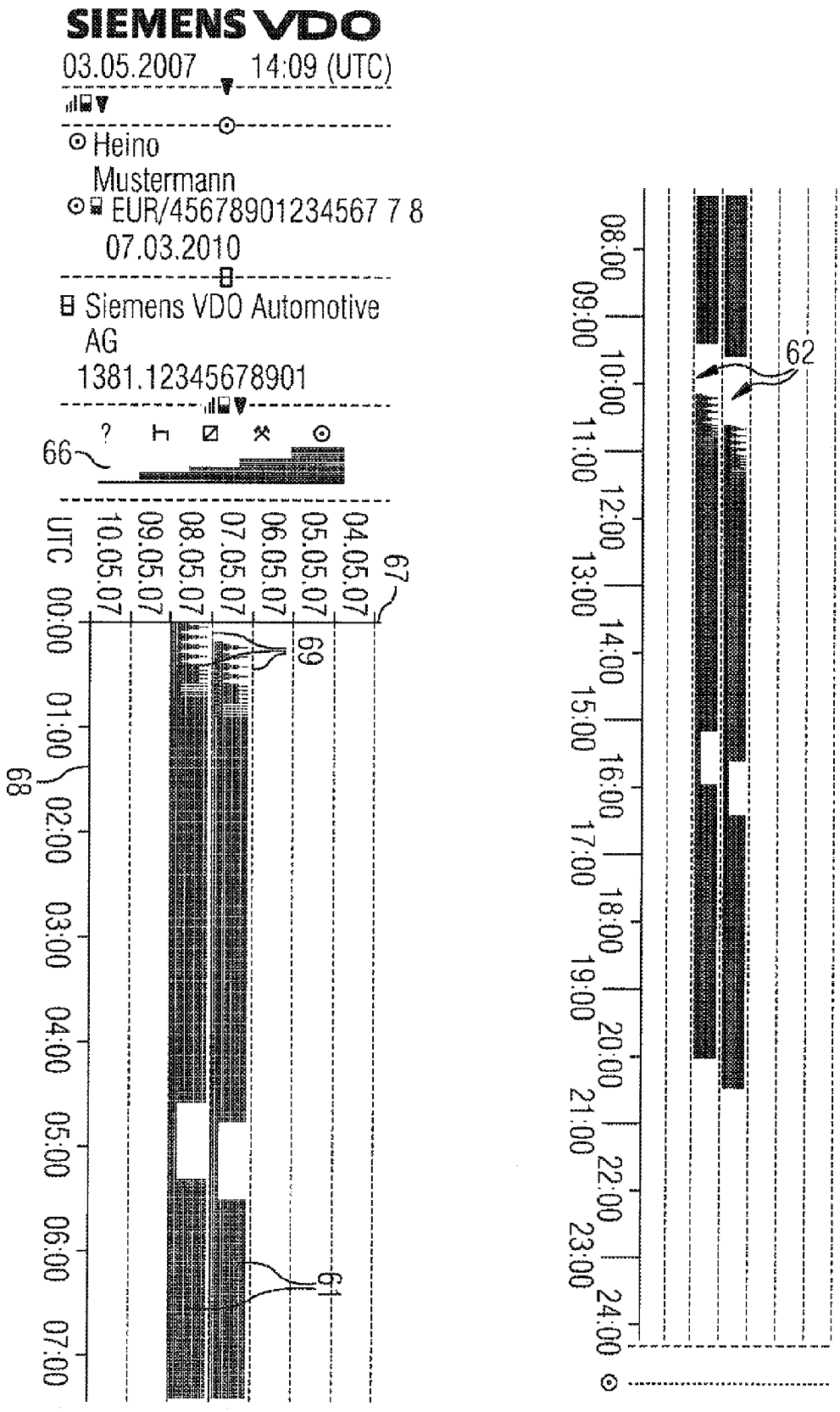
FIG. 5 is a printout of the driver's activities, generated in accordance with the invention.

FIG. 5 shows the driver's activities as a further graphical printout. The printout is again divided into three sections, namely head section, trunk section and foot section with signature field. Whereas head and foot section agree with the speed printout, the trunk with the driver's activity graph is arranged differently. Firstly, a legend 66 is generated which explains the depiction of the activity overview. The activity types of the driver are coded as different heights of steps. The legend is printed out transversely to the direction of running of the printing medium for reasons of space saving.

The ordinate 67 depicts the relevant 7 days. The respective graphs 61 of the driver's activities of the individual days are visually separated from one another by dotted lines 69 through the entire printout.

For periods in which the driver's activity is unknown because, e.g. there was no recording of an activity of a driver in a tachograph in the period, an auxiliary grid 62 is inserted into the graph. This makes it easier for the driver to subsequently enter the missing activities manually in the printout at the correct point.

The abscissa 68 is again divided as in the speed graph, that is to say into hour, quarter hour and 5 minute grids. In this arrangement, the scaling of the abscissa is identical with the printout of the vehicle speed. Thus, the data from the two printouts can be coordinated better with one another during the visual inspection, e.g. by placing the printouts above one another. Regarding the depiction of the activities by the height of the bar, the periods of the respective activities can be detected visually particularly rapidly if they are simply coded by the height of the bar in the printout.

Figure 6:
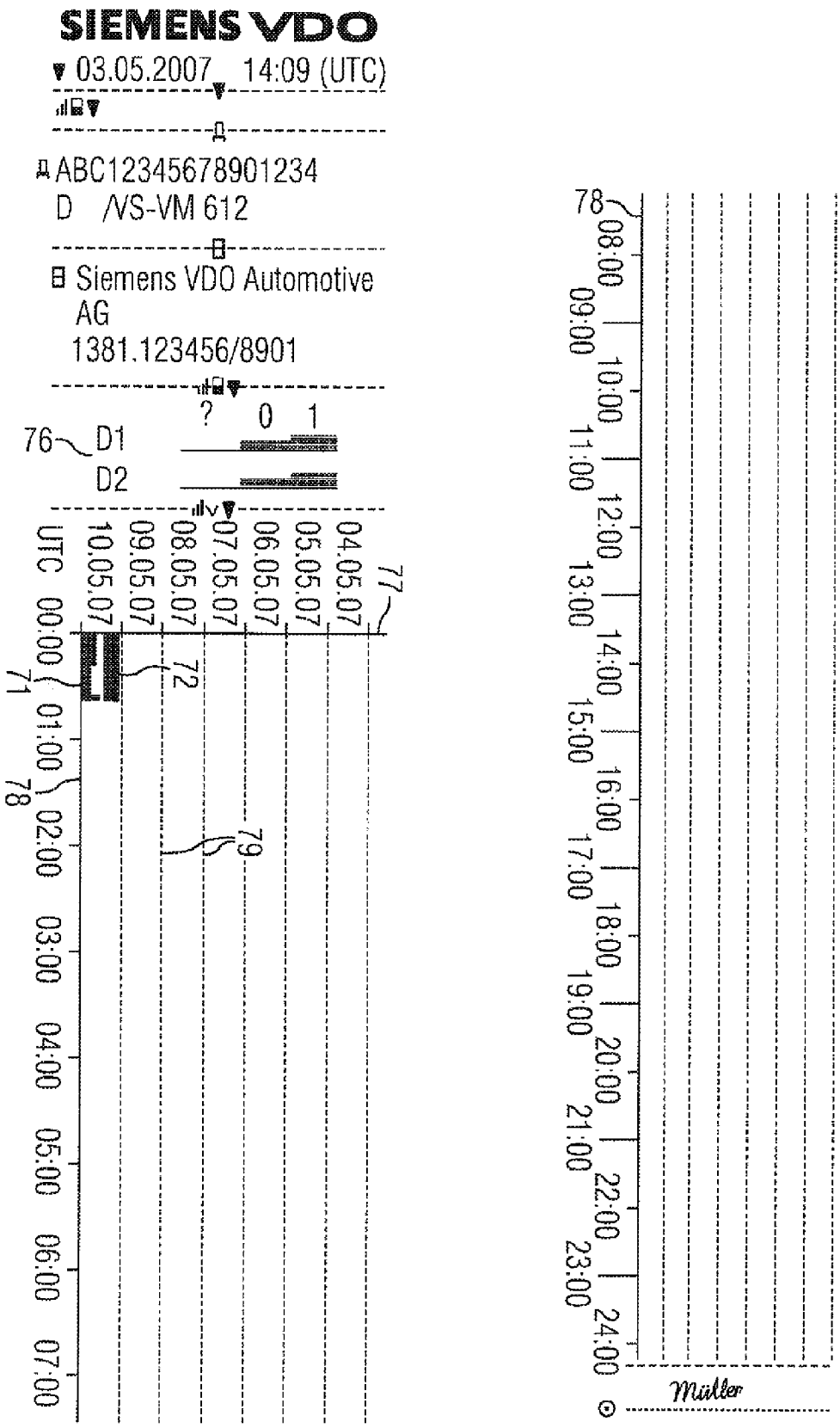
FIG. 6 is a printout of the states of the digital inputs, generated in accordance with the invention.
Figure 7:
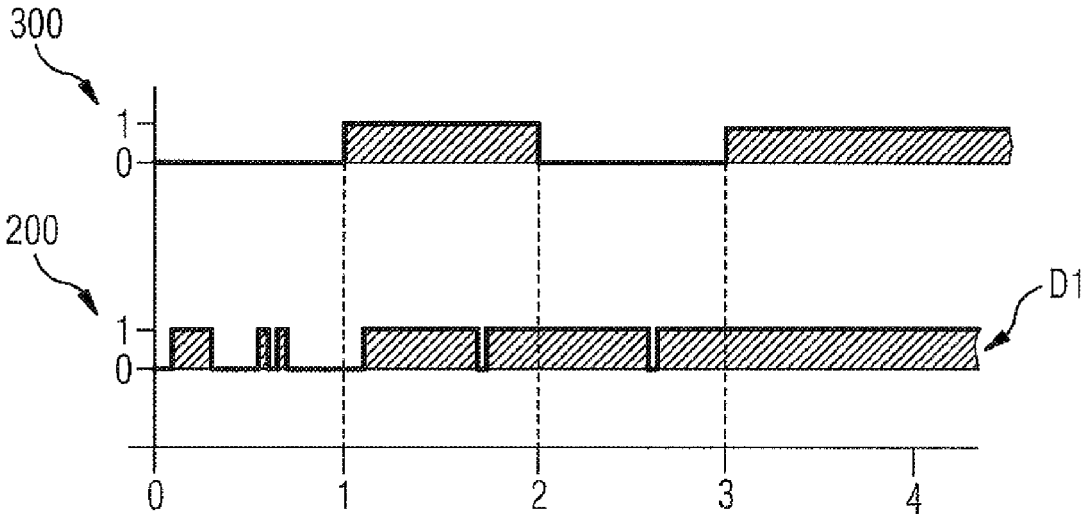
FIG. 7 is a detail of the output of the states according to FIG. 6.

FIG. 6 depicts a graphical printout of the states of the digital (binary) inputs of the tachograph. Head section and foot area with signature field correspond to those in the previous printouts. The trunk section is again scaled on the abscissa 78 exactly as in the previous printouts. This increases the legibility and comparability of the printout. Graphs 71 and 72 reproduce the states of the binary inputs D1 and D2 over time. The coding is also effected by the height of the bar. The legend 76 relating to this is again generated at the beginning of the trunk section. On the ordinate 77, the depicted 7 days are specified. The graphs of the individual days are visually separated from one another by a dotted line 79 through the entire printout. Similarly, the graphs D1 and D2 are visually separated from one another by a dotted line 78 within one day. The state of the input D1 represents, for example, the use of the siren, the state of the input D2 represents, for example, the use of the blue light.

Although the states of the inputs D1, D2 are recorded with an accuracy of seconds in the tachograph, the printout is only generated with an accuracy of minutes. The information to be depicted is therefore generated as follows, for the purpose of better legibility: if there has been no change in state in the recorded data within one minute, the corresponding state is depicted in the printout. If there has been at least one change in state within one minute, a change of the state is depicted on the printout in comparison with the state of the previously printed out minute. This will be explained in greater detail with reference to the example of FIG. 7. Input D1 shall represent the state of the siren, the low value, binary 0, shall signify "siren on", the high value, binary 1, shall signify "siren off". The recording range shall be subdivided into minute intervals 0-1, 1-2, 2-3, 3-4. The graph 200 shall reproduce the state values of D1 recorded in the tachograph. The graph 300 shall represent the generated output on the printing media. In interval 01, there was the state "on", in the interval 1-2 there were several state changes. In depiction 300, therefore, the output value is therefore inverted with respect to the previous interval, that is to say depicted with a low value. In time interval 2-3, there are two changes so that the depiction in the printout is inverted compared with the preceding interval, that is to say depicted with a high bar. In intervals 3-4, there is one change and thus again one inversion of the depiction in the printout. In time interval 4-5, there is no change in the recorded data; thus the state previously depicted in the interval is taken over.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A method for outputting data from a tachograph by printing to an endless printing medium, comprising:

plotting, by the tachograph on the endless printing medium, a first division in a longitudinal direction of the printing medium, the first division representing a predetermined unit of time;

plotting, by the tachograph on the endless printing medium, a second division transversely with respect to the longitudinal direction of the printing medium the second division represents at least one variable recorded by the tachograph during the predetermined unit of time; and depicting, by the tachograph on the endless printing medium, recorded values of at least one variable to be monitored as at least one graph relative to the first and second divisions.

2. The method as claimed in claim 1, wherein the at least one variable is one of speed, driving activity, and a digital state.

3. The method as claimed in claim 1, wherein the graph comprises at least one bar, a height of the bar having discrete steps that characterize the at least one variable.

4. The method as claimed in claim 1, further comprising subdividing the second division into days, wherein the at least one variable is one of a driver's activity and a digital state.

5. The method as claimed in claim 1, further comprising plotting auxiliary lines that facilitate manual entry on the printing medium into the at least one graph instead of the variable to be monitored in an event of a failure of the variable to be monitored.

6. The method as claimed in claim 1, wherein the variable is averaged in a sliding manner over a predetermined number of values and the average value is plotted.

7. The method as claimed in claim 1, wherein a first and a second state, which are variable over the plotted time, are represented in the at least one graph, wherein, in the case of at least one change from the first state to the second state in one interval compared with a state of the preceding interval, the other state of the first and second state is output for the one interval and in the case of no change of the state in the one interval, the state is output for the entire interval.

8. The method as claimed in claim 1, wherein the print output comprises:

a head section that comprises identification data for at least one driver;

a trunk section that comprises the first and second divisions and the at least one graph; and a foot section that comprises a signature field.

9. The method as claimed in claim 8, further comprising printing a legend for the at least one graph in the trunk section.

10. The method as claimed in claim 1, wherein the first division is the same for a predetermined quantity of outputs.

11. The method as claimed in claim 1, further comprising plotting auxiliary lines for delimiting the at least one graph.

12. The method as claimed in claim 1, wherein the printing medium is paper from a roll and the longitudinal direction is the direction of unrolling.

13. The method as claimed in claim 12, wherein the graph comprises at least one bar, a height of the bar having discrete steps that characterize the at least one variable.

14. The method as claimed in claim 1, wherein the predetermined unit of time is a day.

15. A printing device for tachograph wherein the printing device is configured to:

plot, on the endless printing medium, a first division in a longitudinal direction of the printing medium, the first division representing a predetermined unit of time; and plot, on the endless printing medium, a second division transversely with respect to the longitudinal direction of the printing medium the second division represents at least one variable recorded by the tachograph during the predetermined unit of time, the at least one variable to be monitored being depicted, on the endless printing medium, by at least one graph.

16. The printing device for tachograph according to claim 15, wherein the printing device is configured to print:

a head section that comprises identification data for at least one driver;

a trunk section that comprises the first and second divisions and the at least one graph; and a foot section that comprises a signature field.

* * * * *